US007338298B2

(12) United States Patent
Lappoehn

(10) Patent No.: US 7,338,298 B2
(45) Date of Patent: Mar. 4, 2008

(54) PLUG-IN CONNECTION

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 11/465,296

(22) Filed: Aug. 17, 2006

(65) Prior Publication Data

US 2007/0049116 A1 Mar. 1, 2007

(30) Foreign Application Priority Data

Aug. 19, 2005 (DE) ..... 10 2005 039 619

(51) Int. Cl.
*H01R 12/00* (2006.01)

(52) U.S. Cl. ..... 439/83

(58) Field of Classification Search ..... 439/83
See application file for complete search history.

(56) References Cited

U.S. PATENT DOCUMENTS 5,697,799 A * 12/1997 Consoli et al. ..... 439/181
6,461,202 B2 * 10/2002 Kline ..... 439/701
6,848,952 B2 * 2/2005 Norris ..... 439/751
6,948,980 B2 * 9/2005 Xiang et al. ..... 439/607
7,044,812 B2 * 5/2006 Fry et al. ..... 439/876
2004/0092140 A1 * 5/2004 Mashiyama et al. ..... 439/83
2007/0049116 A1 * 3/2007 Lappohn ..... 439/607

FOREIGN PATENT DOCUMENTS

EP 0660445 A1 6/1995
EP 0881866 A1 12/1998
EP 0924806 A1 6/1999

* cited by examiner

*Primary Examiner*—James R. Harvey
(74) *Attorney, Agent, or Firm*—Collard & Roe, P.C.

(57) ABSTRACT

A plug-in connection having at least three multipole contact banks, preferably a plug-in connection comprising a multipoint pin connector and a multipoint slot connector, the multipoint pin connectors having at least one first contact element and the multipoint slot connectors having at least one second contact element, corresponding to the first contact element, is characterized in that solder terminals of the contact elements of at least one contact bank are arranged so that the spacing between the solder terminals of the contact elements of that at least one contact bank and the solder terminals of the contact elements of the remaining contact banks is larger than the spacing between the solder terminals of the contact elements within the remaining contact banks.

5 Claims, 9 Drawing Sheets

PLUG-IN CONNECTION

CROSS-REFERENCE TO PRIOR APPLICATION

This application claims the benefit of German Patent Application No. 10 2005 039 619.4, filed Aug. 19, 2005, which is incorporated by reference herein.

PRIOR ART

The present invention relates to a plug-in connection having at least three multipole contact banks, especially to a plug-in connection comprising a multipoint pin connector and a multipoint slot connector, by means of which electric lines, especially such of electronic parts or components, especially of printed wiring boards, can be connected, preferably in a detachable fashion.

In the case of such plug-in connections, which comprise more than three multipole contact banks, especially four or more such contact banks, contact-making problems are frequently encountered on the printed wiring board. Contact is made via solder connection areas provided in relatively close arrangement one beside the other. That configuration makes it difficult to arrange printed conductors between the solder terminals. Due to the close arrangement of the contact elements, one beside the other, it is also not really easy to arrange usual bores between the solder terminals for providing through-connections, for example to the solder terminals on the opposite side of the printed wiring board. Such through-connections can be realized only by means of the so-called "micro-via technology", where through-bores of very small diameter are produced by laser beams. Due to the spatial conditions existing in known plug-in connections, through-connections through the printed wiring board are possible only by means of such through-bores of very small diameter, it being understood that only correspondingly thin and, thus, interference-prone electric conductors can be used in this case for establishing the through-connection.

Such high technical input is, however, undesirable and in many cases not practicable at all.

Now, it is the object of the present invention to improve a plug-in connection having at least three, especially four or more contact banks so as to permit assembly and contact-making on the printed wiring board in a technically simple way, especially without the use of costly processes such as the before-mentioned "micro-via technology".

ADVANTAGES OF THE INVENTION

This object is achieved according to the invention by a plug-in connection of the before-mentioned kind in that the solder terminals of the contact elements of at least one contact bank are arranged so that the spacing between the solder terminals of the contact elements of that at least one contact bank and the solder terminals of the contact elements of the remaining contact banks is larger than the spacing between the solder terminals of the contact elements within the remaining contact banks.

It is the basic idea of the invention to separate the solder terminals of the contact elements of that at least one contact bank from the solder terminals of the contact elements of the remaining contact banks in such a way that sort of a "duct" is formed between the solder terminals of the contact elements of that contact bank and the solder terminals of the contact elements of the remaining contact banks, in which duct printed conductors or bores known as such, that can be produced with the aid of usual drilling tools, can be provided for permitting through-contacts to be made to the side of the printed wiring board opposite the solder terminals so as to permit the arrangement of additional printed conductors on the opposite side for establishing contacts with the contact elements.

Advantageous embodiments of the plug-in connections are the subject-matter of the sub-claims referred back to claim 1.

According to a preferred embodiment, for example, the plug-in connection comprises an even number of four or more contact banks, said contact banks being combined in pairs so that the spacing between the solder terminals of the contact elements of the pairs of contact banks is larger than the spacing between the solder terminals of the contact elements within each pair of contact banks. That arrangement results in the before-mentioned duct between pairs of contact banks in which printed conductors or through-connections can be arranged.

According to one embodiment, which is easy to realize and which, accordingly, is very advantageous, it is provided that preferably the solder terminals are bent off at the contact elements substantially in L shape.

Preferably, the solder terminals are formed integrally on the contact elements. This is favorable with respect to both their stability and their manufacturability.

Advantageously, the arrangement then is such that the solder terminals of the contact elements, bent in L form, of the first pair of contact banks are arranged to face away from the angled solder terminals of the second pair of contact banks. As a result of that arrangement, the desired hollow space, described above as duct, is produced between the solder terminals for accommodating printed conductors or bores for through-connections.

According to one advantageous embodiment, the solder terminals, bent off in L form, of the contact elements of the first pair of contact banks are substantially arranged at an angle of 180° relative to the angled solder terminals of the contact elements of the second pair of contact banks. Due to that arrangement of the L-shaped solder terminals on the contact elements the duct is realized in a simple way, while at the same time solder terminals of sufficient size for establishing contact with the solder pads provided for that purpose on the carrier board can be realized.

In order to provide such a plug-in connection with a polarity reversal protection, while allowing on the other hand especially that, for example, multipoint pin connectors having only two pairs of contact banks can be plugged into a multipoint slot connector having four pairs of contact banks, and vice versa, the shells accommodating the pin connectors and the slot connectors, respectively, are each provided at their end faces with ridges and grooves, respectively, in non-symmetrical arrangement so that the ridges or grooves provided on the multipoint pin connector have a configuration complementary to the grooves or ridges arranged on the multipoint slot connector.

The ridges and grooves are, accordingly, adapted one to the other so that, for example, a multipoint pin connector having four contact banks can be connected with a multipoint slot connector having four contact banks in a single position only. At the same time, it is however also possible to connect two multipoint pin connectors having each two contact banks with a multipoint slot connector having four contact banks. In that case, the multipoint pin connectors having each two contact banks are provided with ridges each of which fits into one of the grooves in the shell of the multipoint slot connector. Correspondingly, it is also possible to connect two multipoint slot connectors, each having two contact banks, with one multipoint pin connector having four contact banks.

DRAWING

Further advantages and features of the invention are the subject of the specification that follows and of the illustration of one embodiment of the invention.

DESCRIPTION OF THE EMBODIMENTS

Figure 1:
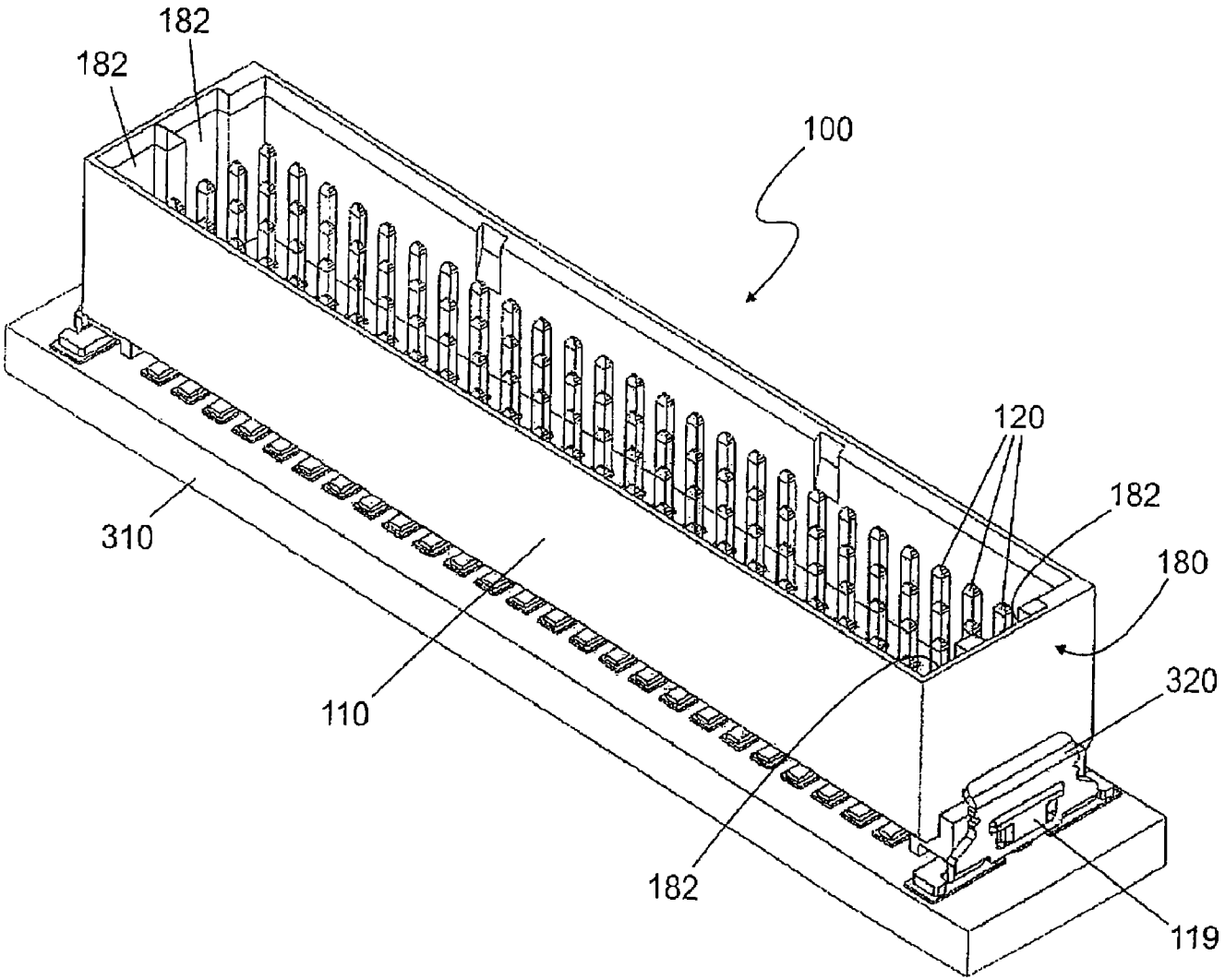
FIG. 1 shows a diagrammatic illustration of a multipoint pin connector of a plug-in connection according to the invention.
Figure 2:
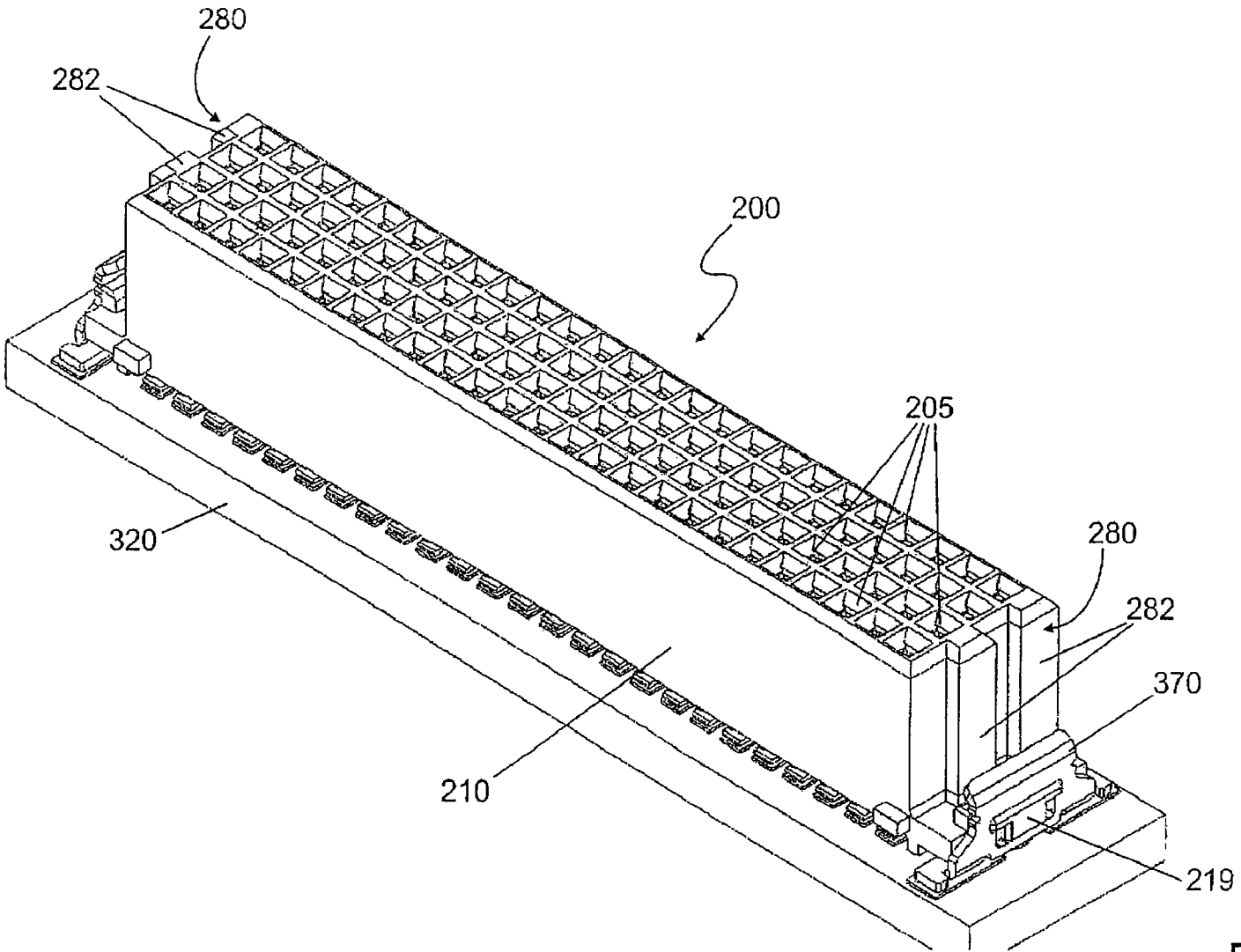
FIG. 2 shows a multipoint slot connector of the plug-in connection.

A plug-in connection comprises a multipoint pin connector indicated generally by reference numeral 100 and illustrated in FIG. 1, arranged for example on a carrier board 310, and a multipoint slot connector designated generally by reference numeral 200 and illustrated in FIG. 2, arranged for example on a different carrier board 320.

The multipoint pin connector 100 comprises a shell 110 that contains in its interior contact elements 120 arranged in the form of banks. In the case of the multipoint pin connector 100, there can be seen a total of four banks of contact elements 120, provided in linear arrangement one behind the other.

The multipoint slot connector 200 likewise comprises a shell 210 that contains in its interior spring elements—not visible in FIG. 2—, likewise arranged in the form of banks one behind the other. The multipoint slot connector 200 illustrated in FIG. 2 likewise comprises a total of four banks of contact elements arranged one beside the other. Inside the shell 210, conical openings 205, each lying above a spring contact element 220 (FIG. 4), are provided above each of the banks for supporting the self-centering introduction of the contact elements 120 of the multipoint pin connector 100.

Figure 3:
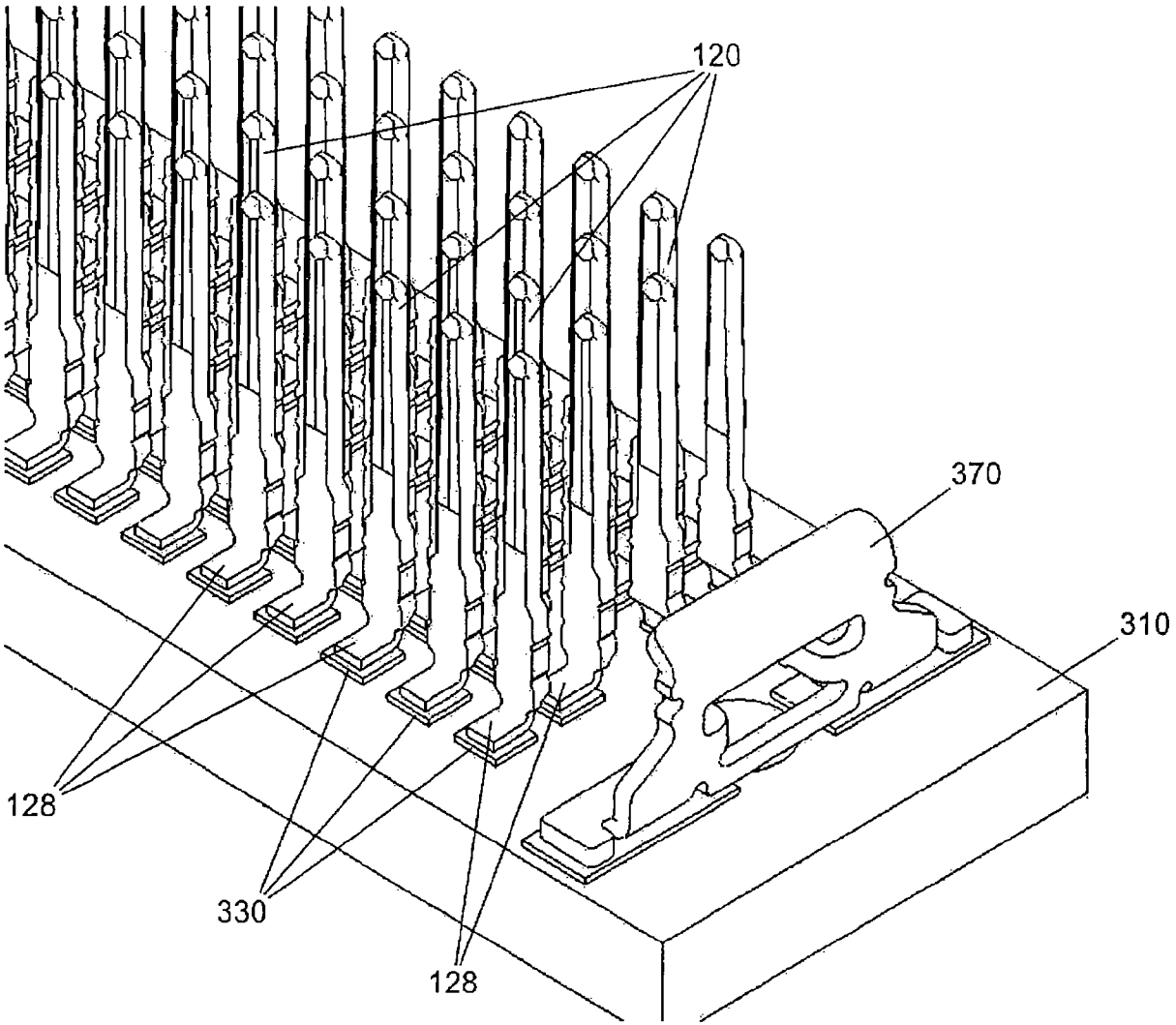
FIG. 3 shows a diagrammatic illustration of the contact elements, arranged in the form of banks, of the multipoint pin connector according to FIG. 1.
Figure 4:
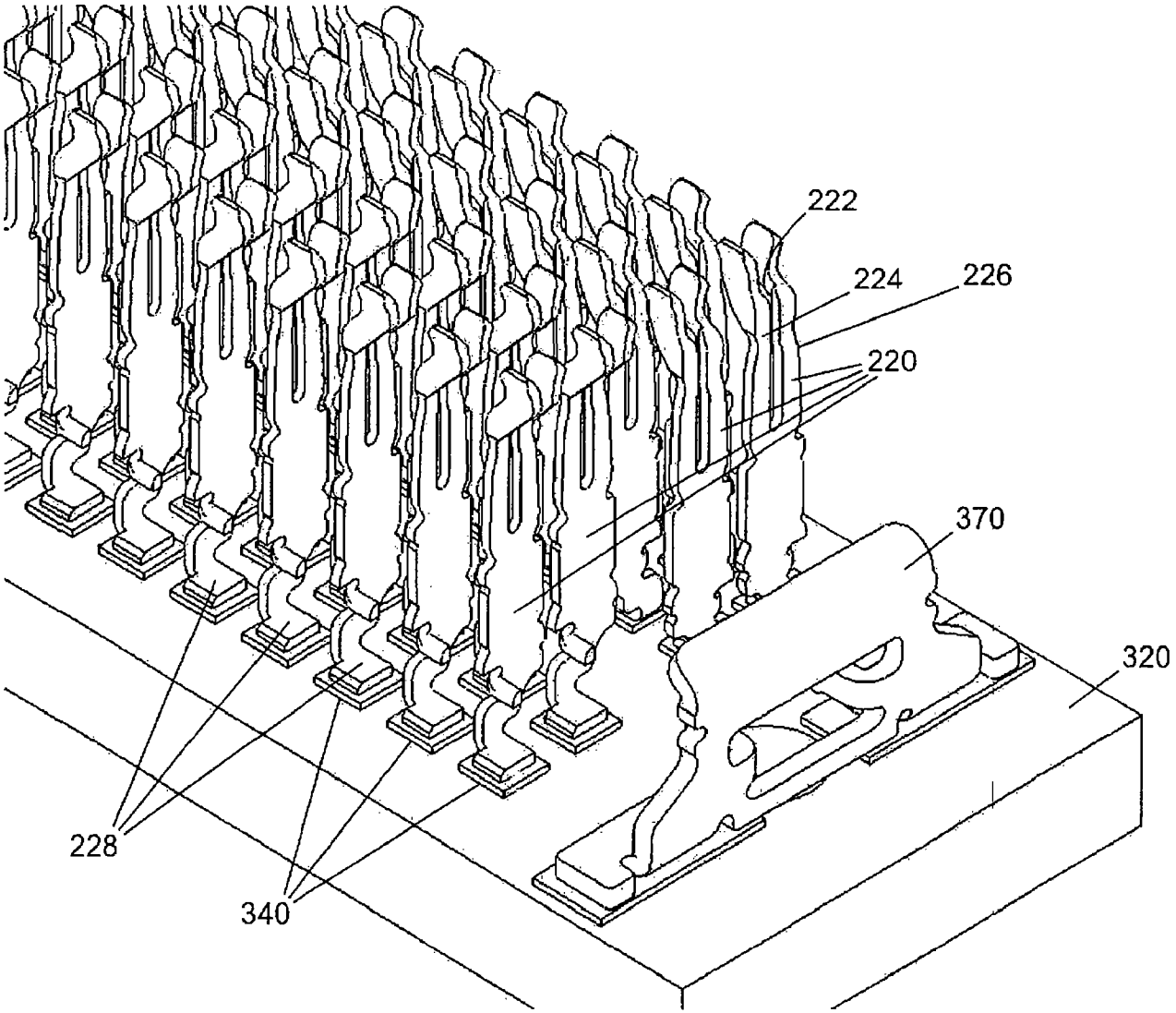
FIG. 4 shows a diagrammatic illustration of the contact elements, arranged in the form of banks, of the multipoint slot connector according to FIG. 2.

The spring contact elements 220 are illustrated in detail in FIG. 4. They exhibit a substantially V-shaped configuration having an opening 222 in which the pin-shaped contact elements 120 (FIG. 3) of the multipoint pin connector 100 are fitted in the plugged condition, and are retained by the elastic force of two spring elements 224, 226 arranged on each spring contact element 22(i. For establishing the contact, the multipoint pin connector illustrated in FIG. 3 is rotated about a horizontal line by 180° whereby the pin-shaped contacts 120 are introduced into the openings 222 of the spring contact elements 220.

The arrangement of the contact elements 120 and 220, respectively, in the form of banks arranged one behind the other, can be seen especially clearly in FIG. 3 and FIG. 4. In the illustrated embodiment, four banks of contact elements 120 and 220, respectively, are arranged one behind the other. Contacts are established by the contact elements 120 and 220, respectively, with the printed wiring board 310 in the case of the multipoint pin connector 100 and with the printed wiring board 320 in the case of the multipoint slot connector 200, respectively, via solder terminals (soldering pads) 330 and 340, respectively.

As can be seen especially in FIG. 3, FIG. 4, FIG. 5 and FIG. 6, the contact elements 120 and 220, respectively, are provided on their sides facing toward the printed wiring boards 310 and 320, respectively, with substantially L-shaped solder terminals 128 and 228, respectively, which are connected in electrically conductive fashion with corresponding soldering pads 330 which are arranged on the printed wiring boards 310 or 320, respectively, using the SMT technology.

Figure 5:
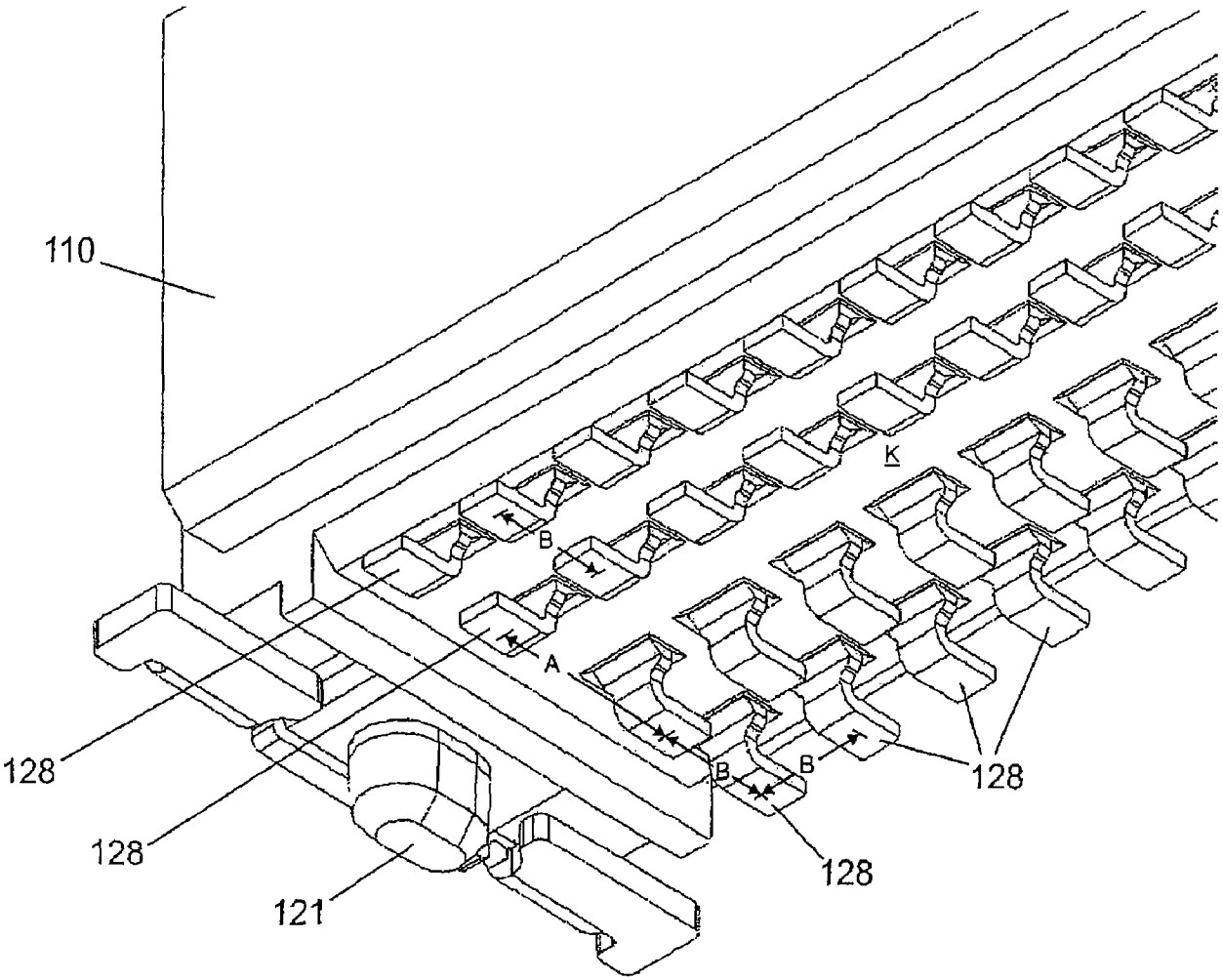
FIG. 5 shows a bottom view of the multipoint pin connector illustrated in FIG. 1.
Figure 6:
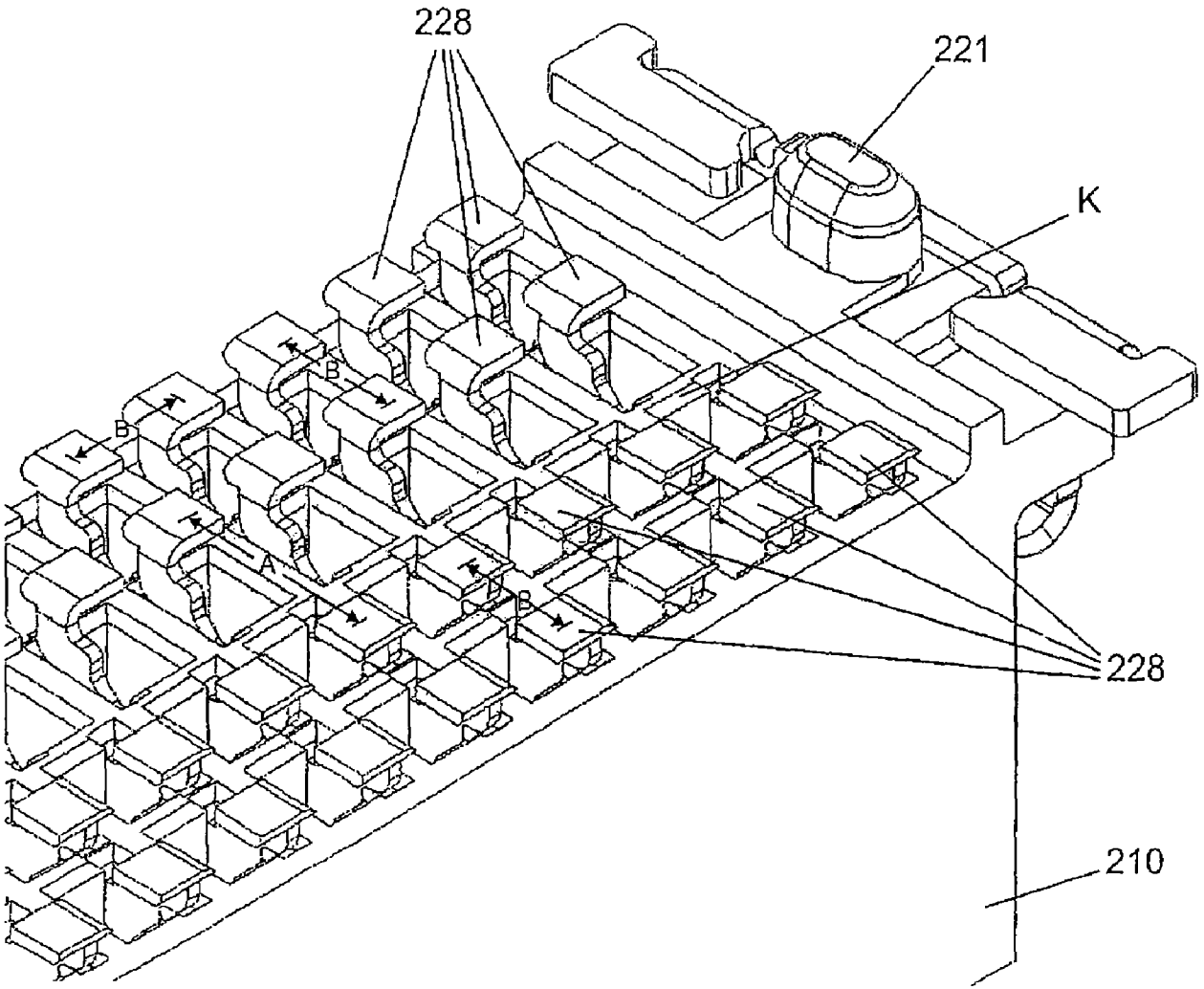
FIG. 6 shows a bottom view of the multipoint slot connector illustrated in FIG. 2.

As can be further seen in FIGS. 5 and 6, the solder terminals 128 and 228, respectively, of each pair of combined contact elements 120 and 220, respectively, are arranged at an angle of 180° one relative to the other so that the spacing A between the contact elements 120 or 220, respectively, of neighboring contact banks of different pairs of contact banks is larger than the distance B between the solder terminals 128 and 228, respectively, of the contact elements 120 and 220, respectively, within one pair of contact banks. One thereby obtains a duct K between the pairs of contact banks which is suited, for example, to receive printed conductors or through-connection bores provided on the carrier boards 310 and 320, respectively (not shown in FIGS. 1 to 4).

Figure 9:
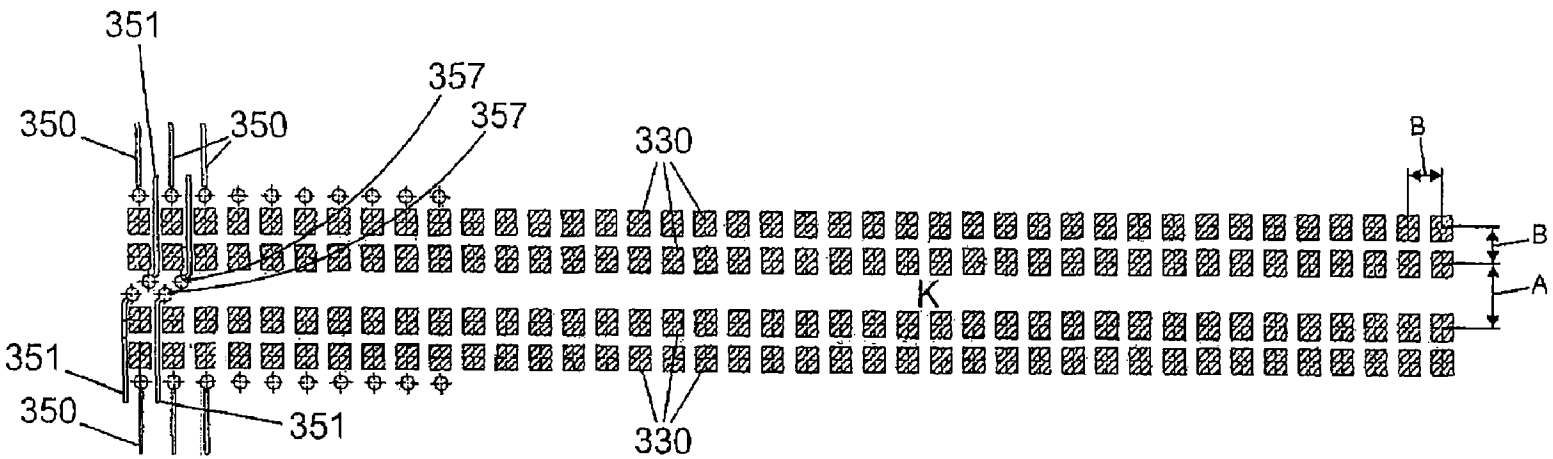
FIG. 9 shows a diagrammatic illustration of the solder terminals of the multipoint pin connector and the multipoint slot connector, respectively, of a plug-in connector according to the invention.

The layout of the solder terminals on the carrier boards 310 and 320 is illustrated diagrammatically in FIG. 9. As can be seen in FIG. 9, the spacing A of soldering pads 330 of contact elements of one contact bank of one pair of contact banks relative to the soldering pads 330 of the contact elements of one contact bank of a neighboring pair of contact banks is larger than the spacing B of the soldering pads 330 of the contact elements of the contact banks within one pair of contact banks. In FIG. 9, through-connections 357 and printed conductors 350, 351 are shown diagrammatically. These may be arranged in the duct K, which otherwise would not be easy to realize between the soldering areas within a pair of contact banks.

As can be further seen, especially in FIGS. 1 to 4, snap-in elements 370 are provided, likewise by means of soldered connections, on each of the carrier boards 310 and 320, for snapping in corresponding detents 119 and 219, respectively, of the shells 110 and 210. For centering the shells 110 and 210 on the printed wiring board, they may further be provided with centering pins 121 and 221 facing toward the carrier boards 310, 320, for engaging into corresponding openings in the carrier boards 310, 320 in form-locking relationship.

Figure 7:
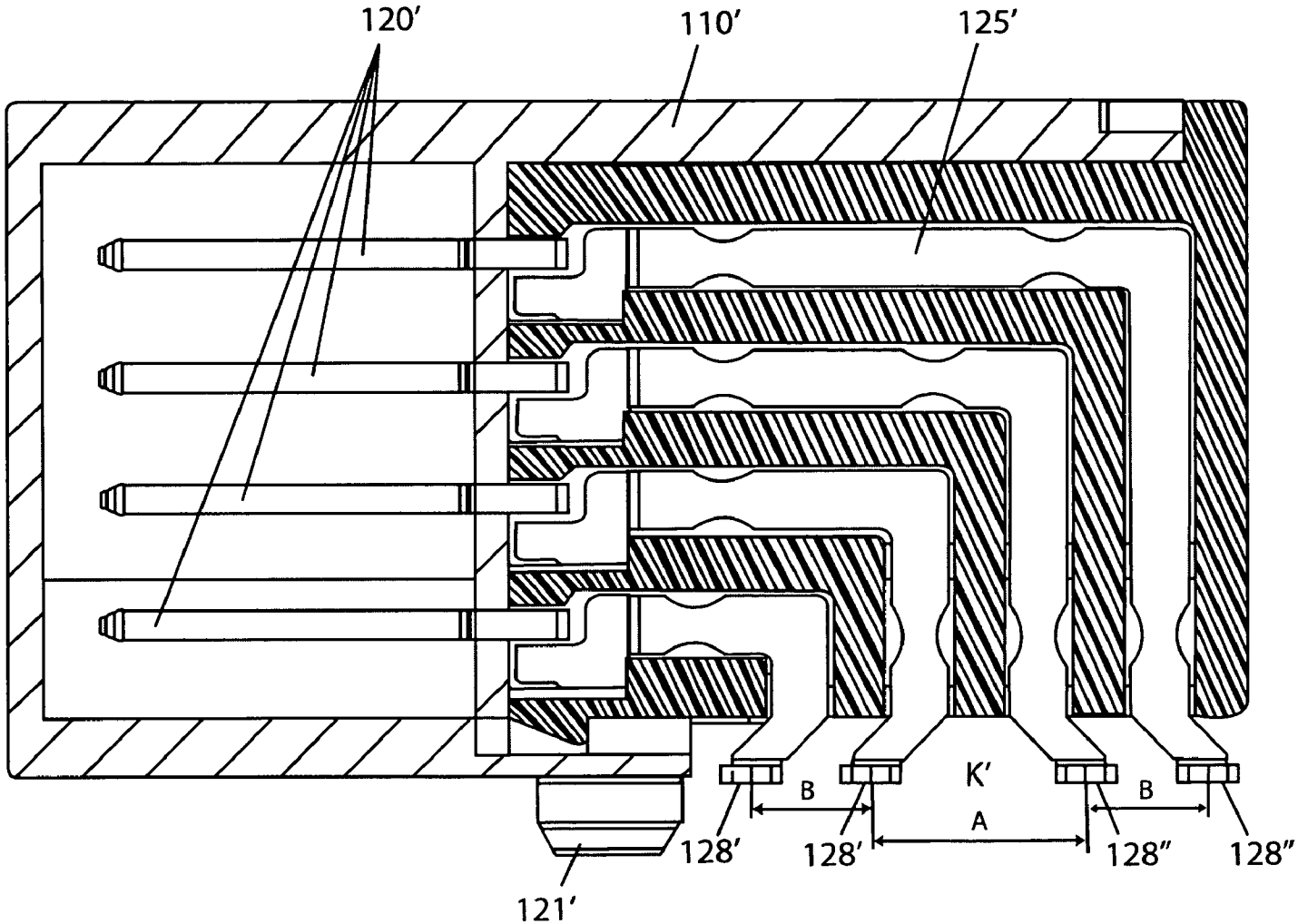
FIG. 7 shows a section through another embodiment of a multipoint pin connector with laterally arranged contact elements.
Figure 8:
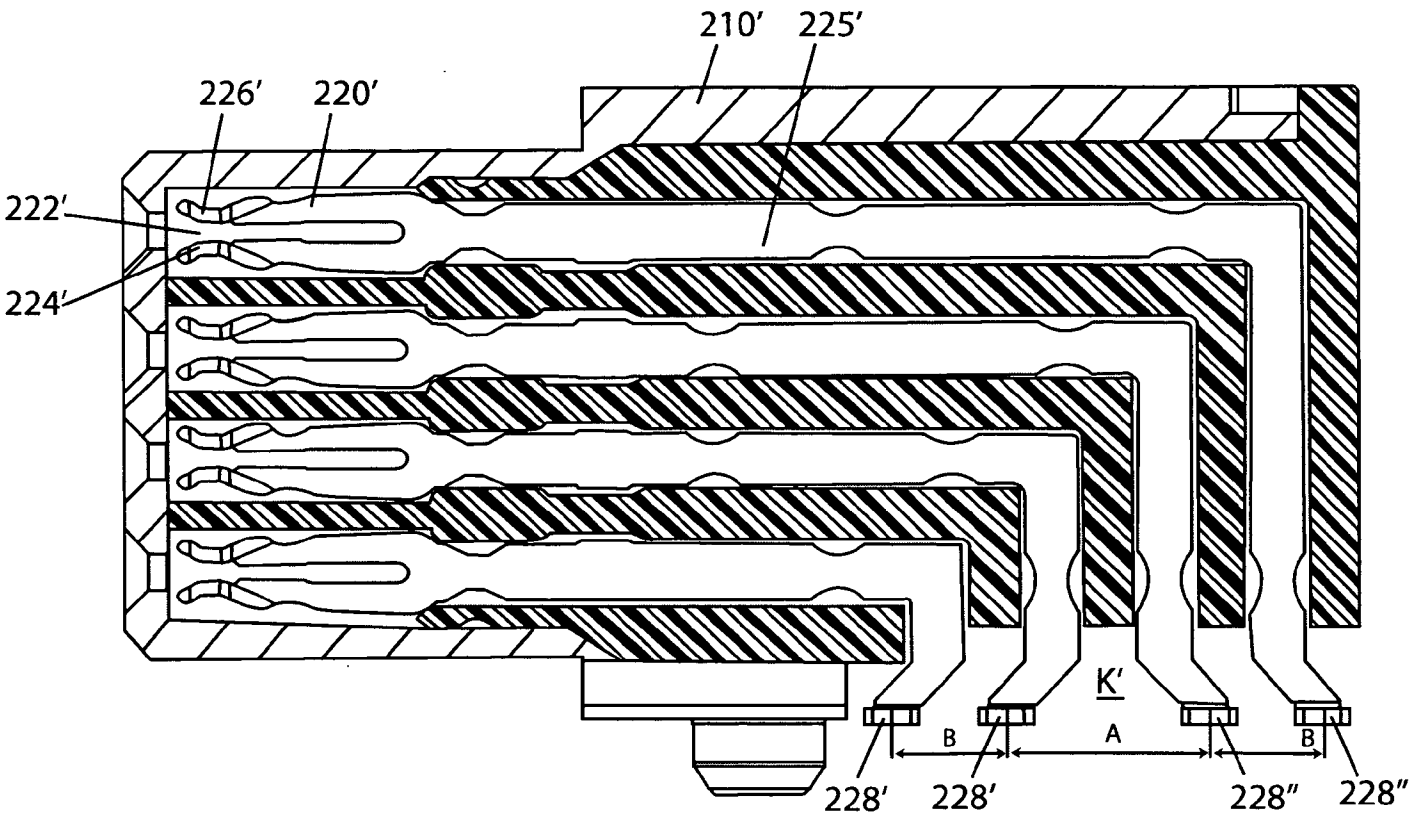
FIG. 8 shows a section through a multipoint slot connector, matching the multipoint pin connector illustrated in FIG. 7, with laterally arranged contact elements.

The exemplary embodiments of a multipoint pin connector and a multipoint slot connector illustrated in FIG. 7 and FIG. 8 differ from the multipoint pin connector and the multipoint slot connector illustrated in FIGS. 1 to 6 insofar as the contact elements issue from the connectors laterally, which means that they are arranged substantially in parallel to the printed wiring board 310, 320, instead of vertically to the printed wiring board 310, 320. The printed wiring board is shown in FIG. 7 and FIG. 8.

As illustrated in FIG. 7, the contact elements 120' are arranged in the form of banks and are connected with solder terminals 128' via angled conductive connections 125'. The angled arrangement of the solder terminals 128' is such that the spacing A between the solder terminals 128' of one pair of contact banks and the solder terminals 128" of a neighboring pair or contact banks is larger than the spacing B between the solder terminals 128' and 128", respectively, within one pair of contact banks.

The contact elements of the multipoint pin connector are correspondingly arranged in a shell 210', the spring contacts 220' comprising spring arms 222', 224' provided with an opening 226' for receiving the pin-like contact elements 120' illustrated in FIG. 7. Each of the spring contacts 220' is connected with angled solder terminals 228' or 228", respectively, via conductive connections 225' arranged in the shell 210', the solder terminals of the contact elements of neighboring contact banks of different pairs of contact banks being again arranged at a spacing A larger than the spacing B between the contact banks of the contact elements of neighboring contact banks within one pair of contact banks so that a duct K' is formed between the solder terminals of every two neighboring pairs of contact banks, for arranging printed conductors or through-connection bores in the way described above.

It is understood that the invention is not limited to plug-in connections having four contact banks. Instead, it is also possible according to the invention to give a plug-in connection with three contact banks a configuration where two contact banks, for example, are combined to one pair of contact banks while the third contact bank is configured so that the soldering areas of the contact elements of that contact bank are arranged at a larger spacing from the soldering areas of the contact elements of the contact banks of the pair of contact banks.

Correspondingly, it is also possible to configure plug-in connections having more than four contact banks, in which case it has been found to be of great advantage if an even number of contact banks is provided in order to combine all contact banks to pairs and to form between those pairs ducts similar to those described above for arranging printed conductors or through-connection bores or the like in such ducts.

As can be seen in FIG. 1 and FIG. 2, grooves 182, facing toward the contact elements 120, are provided in unsymmetrical arrangement on the end faces of the shell 110 of the multipoint pin connector 100. Correspondingly, ridges 282 are provided on the end faces 280 of the shells 210 of the multipoint slot connectors 200, which ridges are adapted to the grooves 182 so that when a plug-in connection is established between the multipoint pin connector 100 and the multipoint slot connector 200, the multipoint pin connector 100 can be connected with the multipoint slot connector 200 in a single position only. This makes the connection non-interchangeable.

The grooves 182 and the ridges 282 are in this case arranged in such a way that a multipoint slot connector 200, having four contact banks for example, can also receive two multipoint pin connectors 100, each having two contact banks. In this case, the multipoint pin connector 100, having only two contact banks, only has a single groove so that polarity reversal protection is provided in this case as well, the arrangement allowing two multipoint pin connectors to be fitted in the multipoint slot connector 200 in a single arrangement only, one behind the other.

The invention claimed is:

1. Plug-in connection having at least three multipole contact banks, comprising a multipoint pin connector and a multipoint slot connector, the multipoint pin connectors (100) having at least one first contact element (120) and the multipoint slot connectors (200) having at least one second contact element (220), corresponding to the first contact element, wherein solder terminals (128, 228; 128', 228') of the contact elements (120, 220; 120', 220') of at least one contact bank are arranged so that the spacing between the solder terminals (128, 228; 128', 228) of the contact elements (120, 220, 120', 220') of that at least one contact bank and the solder terminals (128, 228; 128', 228') of the contact elements (120, 220; 120' 220') of the remaining contact banks is larger than the spacing between the solder terminals (128, 228; 128', 228') of the contact elements (120, 220; 120', 220') within the remaining contact banks, wherein the solder terminals (128, 228; 128', 228') are bent off at the contact elements (120, 220; 120', 220') substantially in L shape, and wherein the angled solder terminals (128, 228; 128', 228') of the contact elements (120, 220; 120', 220') of a first pair of contact banks are arranged to face away from the angled solder terminals (128, 228; 128', 228') of the contact elements (120, 220; 120',220') of a neighboring pair of contact banks.

2. The plug-in connection as defined in claim 1, comprising an even number of four or more contact banks, said contact banks being combined in pairs so that the spacing between the solder terminals (128, 228; 128', 228') of the contact elements (120, 220; 120', 220') of the pairs of contact banks is larger than the spacing between the solder terminals (128, 228; 120', 228') of the contact elements (120; 220; 120', 220') within each pair of contact banks.

3. The plug-in connection as defined in claim 1, wherein the solder terminals (128, 228; 128', 228') are formed integrally on the contact elements (120, 220; 120', 220').

4. The plug-in connection as defined in claim 1, wherein the angled solder terminals (128, 228; 128', 228') of one contact element (120, 220; 120', 220') of one terminal bank of the first pair of contact banks are substantially arranged at an angle of 180° relative to the angled solder terminals (128, 228; 128', 228') of the contact elements (120, 220; 120', 220') of a contact bank neighboring pair of contact banks.

5. The plug-in connection as defined in claim 1, further comprising shells (110, 210) receiving the pin connectors and the slot connectors, respectively, each of said shells provided at their end faces (180, 280) with ridges (282) and grooves (182), respectively, in non-symmetrical arrangement so that the grooves or ridges (182) provided on the multipoint pin connector have a configuration complementary to the grooves or ridges (282) arranged on the multipoint slot connector.

* * * * *